US010941518B2

(12) United States Patent
Quaresma Ribeiro Campos et al.

(10) Patent No.: US 10,941,518 B2
(45) **Date of Patent: *Mar. 9, 2021**

(54) CUT-RESISTANT FABRIC AND ARTICLES INCLUDING CUT-RESISTANT FABRIC

(71) Applicant: Ansell Limited, Richmond (AU)

(72) Inventors: Maria Ines Quaresma Ribeiro Campos, Vila Nova de Poiares (PT); Geraldo Alexandre Pimentel de Oliveira, Coimbra (PT); Marco Antonio Francisco Costa, Vila Nova de Poiares (PT); Paulo Alexandre Goncalves Francisco, Vila Nova de Poiares (PT)

(73) Assignee: Ansell Limited, Victoria (AU)

( * ) Notice: Subject to any disclaimer, the term of this patent is extended or adjusted under 35 U.S.C. 154(b) by 870 days.

This patent is subject to a terminal disclaimer.

(21) Appl. No.: 14/933,122

(22) Filed: Nov. 5, 2015

(65) Prior Publication Data

US 2016/0122942 A1 May 5, 2016

Related U.S. Application Data

(60) Provisional application No. 62/131,315, filed on Mar. 11, 2015, provisional application No. 62/083,636, filed on Nov. 24, 2014, provisional application No. 62/075,597, filed on Nov. 5, 2014.

(51) Int. Cl.

| | |
|---|---|
| ***D06M 15/693*** | (2006.01) |
| ***D06M 15/564*** | (2006.01) |
| ***D06M 15/31*** | (2006.01) |
| ***D06M 23/08*** | (2006.01) |
| ***D06M 101/34*** | (2006.01) |
| ***D06M 101/06*** | (2006.01) |
| ***A41D 31/24*** | (2019.01) |

(52) U.S. Cl.

CPC ..... *D06M 15/693* (2013.01); *D06M 15/31* (2013.01); *D06M 15/564* (2013.01); *D06M 23/08* (2013.01); *A41D 31/245* (2019.02); *D06M 2101/06* (2013.01); *D06M 2101/34* (2013.01)

(58) Field of Classification Search

CPC . A41D 31/00; A41D 31/0061; D06M 15/564; D06M 15/693; D06M 2101/06; D06M 2101/34

See application file for complete search history.

(56) References Cited

U.S. PATENT DOCUMENTS

| | | | |
|---|---|---|---|
| 2009/0077713 | A1 | 3/2009 | Saunders et al. |
| 2011/0300366 | A1 | 12/2011 | Henssen |
| 2012/0233740 | A1 | 9/2012 | Veillet |
| 2013/0125283 | A1 | 5/2013 | Henssen et al. |
| 2014/0000006 | A1 | 1/2014 | Perera et al. |
| 2014/0272361 | A1 | 9/2014 | Howland |

OTHER PUBLICATIONS

International Search Report and Written Opinion dated Jan. 28, 2016 for PCT Application No. PCT/AU2015/000666.

Extended European Search Report dated May 3, 2018 for Application No. 15856749.5-1107.

*Primary Examiner* — Arti Singh-Pandey

(74) *Attorney, Agent, or Firm* — Moser Taboada

(57) ABSTRACT

Provided among other things is a cut-resistant article comprising: a cut-resistant synthetic fabric; and adherent to the fabric a layer of polymer in which is dispersed mineral fibers of hardness about 4 Mohs or higher and having L/D ratio between about 8 and about 16, wherein the article has a cut resistance by ISO 13997:1999 of 2 or higher.

20 Claims, 5 Drawing Sheets

CUT-RESISTANT FABRIC AND ARTICLES INCLUDING CUT-RESISTANT FABRIC

CROSS-REFERENCE TO RELATED APPLICATIONS

The current application claims benefit of U.S. Ser. No. 62/131,315, filed Mar. 11, 2015, U.S. Ser. No. 62/083,636, filed Nov. 24, 2014, and U.S. Ser. No. 62/075,597, filed Nov. 5, 2014, the contents of which are incorporated herein in their entireties.

BACKGROUND

Field of the Invention

The present application relates generally to cut-resistant polymer-coated fabrics that incorporate mineral fibers in the polymer coating.

Description of Related Art

Henssen et al., U.S. Pat. Publ. 2013/0125283, describes articles having mineral fibers in a polymer coating where the fibers are said to have a range of length-to-diameter (L/D) ratios. The Hessen application however only experimentally illustrates these articles with mineral fibers having an L/D ratio of 25.6. Nothing in Henssen discloses or suggests that using an L/D ratio of 5 to 16 (by the L/D measurement method set forth in Example 1 of Henssen) would have remarkably greater cut resistance than using a similar mineral fiber with L/D ratio of 17.9.

Neither does Henssen disclose or suggest that polyurethane/nitrile coated cut resistant polyamide fabric would have the cut resistance described herein.

SUMMARY

Provided in one embodiment is a cut-resistant article comprising: a fabric (including a cut-resistant fabric or a non-cut-resistant fabric); and adherent to the fabric a layer of polymer in which is dispersed mineral fibers of hardness about 4 Mohs or higher and having L/D ratio between about 8 and about 16, wherein the article has a cut resistance by ISO 13997:1999 (or EN388) of 2 or higher, or 3 or higher, or 4 or higher, or 5 or higher. The fabric can be of synthetic, semi-synthetic (e.g., polycotton), or natural fiber. The fabric can be shaped as an article, such as a glove, and as an article can be seamless or seamed.

Provided in a further embodiment is a cut-resistant article comprising: a synthetic cut-resistant fabric (including a semi-synthetic fabric); and adherent to the fabric a layer of polymer in which is dispersed mineral fibers of hardness about 4 Mohs or higher and having L/D ratio between about 8 and about 16, wherein the article has a cut resistance by ISO 13997:1999 (or EN388) of 2 or higher, or 3 or higher, or 4 or higher, or 5 or higher. The fabric can be of synthetic, semi-synthetic, or natural fiber.

Provided in another embodiment is a cut-resistant article comprising: (a) a cut-resistant synthetic fabric that is a 70% or more polyamide; and (b) adherent to the fabric a layer of polymer comprising about 5% or more polyurethane and about 60% or more nitrile in which is dispersed mineral fibers of hardness about 4 Mohs or higher and having L/D ratio between about 8 and about 27, wherein the article has a cut resistance by ISO 13997:1999 (or EN388) of 2 or higher, or 3 or higher, 4 or higher, and wherein the polymer is adhered to the fabric by coagulation-mediated dip coating onto the fabric, and subsequent curing.

Provided in a further embodiment is a method of forming a cut-resistant article comprising: (1) applying a coagulant to a fabric; (2) coagulating on the fabric a layer of polymer in which is dispersed mineral fibers of hardness about 4 Mohs or higher and having L/D ratio between about 8 and about 27; (3) curing the coagulated polymer; and (4) obtaining the article, which has a cut resistance by ISO 13997:1999 (or EN388) of 2 or higher, or 3 or higher, or 4 or higher.

Provided in a further embodiment is a method of forming a cut-resistant article comprising: (1) applying a coagulant to a cut-resistant synthetic fabric; (2) coagulating on the fabric a layer of polymer in which is dispersed mineral fibers of hardness about 4 Mohs or higher and having L/D ratio between about 8 and about 27; (3) curing the coagulated polymer; and (4) obtaining the article, which has a cut resistance by ISO 13997:1999 (or EN388) of 2 or higher, or 3 or higher, or 4 or higher.

Provided in another embodiment is a cut-resistant article comprising: (A) a fabric; and (B) adherent to the fabric a layer of polymer in which is dispersed mineral fibers of hardness about 4 Mohs or higher and having L/D ratio between about 8 and about 27, wherein the article has a cut resistance by ISO 13997:1999 (or EN388) of 2 or higher, or 3 or higher, or 4 or higher, or 5 or higher, wherein the article has one or more features indicative of layer of polymer being applied by a process wherein coagulant is applied to the fabric to coagulate a coagulation-sensitive dispersion of polymer to form the layer of polymer.

Provided in another embodiment is a cut-resistant article comprising: (A) a cut-resistant synthetic fabric; and (B) adherent to the fabric a layer of polymer in which is dispersed mineral fibers of hardness about 4 Mohs or higher and having L/D ratio between about 8 and about 27, wherein the article has a cut resistance by ISO 13997:1999 (or EN388) of 2 or higher, or 3 or higher, or 4 or higher, or 5 or higher, wherein the article has one or more features indicative of layer of polymer being applied by a process wherein coagulant is applied to the cut-resistant synthetic fabric to coagulate a coagulation-sensitive dispersion of polymer to form the layer of polymer.

DESCRIPTION OF THE DRAWINGS

Embodiments of the present disclosure, briefly summarized above and discussed in greater detail below, can be understood by reference to the illustrative embodiments of the disclosure depicted in the appended drawings. However, the appended drawings illustrate only typical embodiments of the disclosure and are therefore not to be considered limiting of scope, for the disclosure may admit to other equally effective embodiments.

Figure 1:
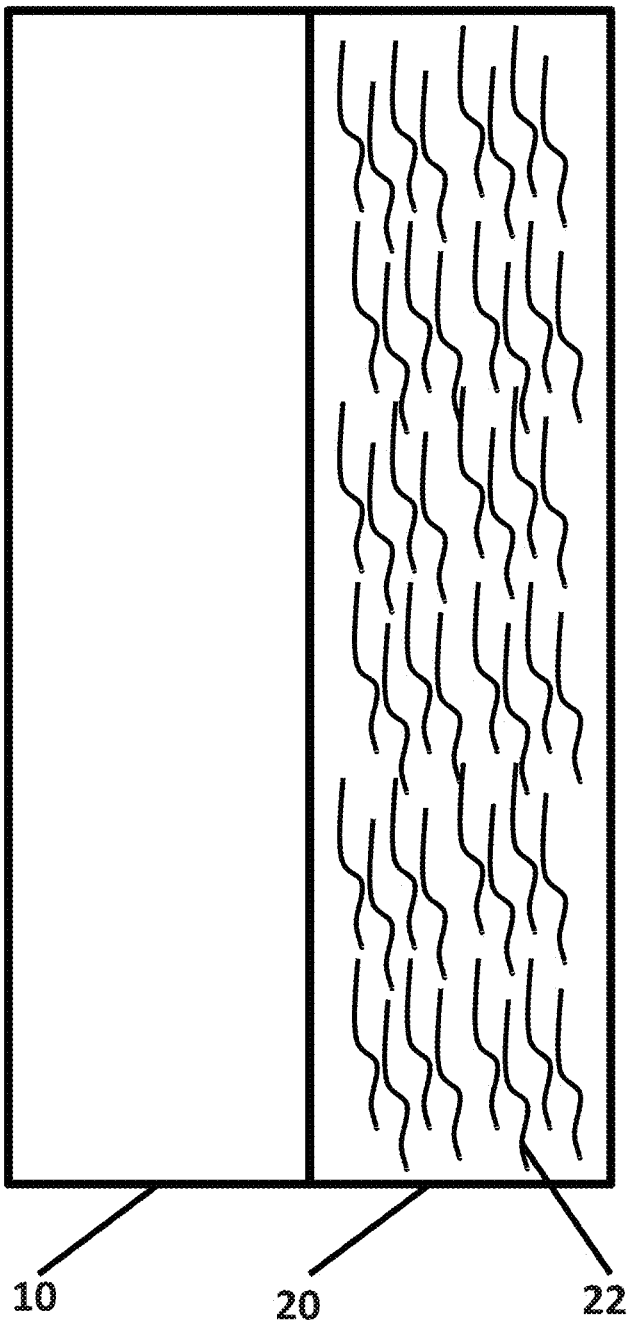
FIG. 1 depicts schematically a portion of an article of the invention in cross-section.

To facilitate understanding, identical reference numerals have been used, where possible, to designate comparable elements that are common to the figures. The figures are not drawn to scale and may be simplified for clarity. It is contemplated that elements and features of one embodiment may be beneficially incorporated in other embodiments without further recitation.

DETAILED DESCRIPTION

FIG. 1 depicts schematically a fabric 10 coated with a polymer layer 20 in which are dispersed fibers 22.

The cut-resistant articles of the invention are formed on fabric supports, such as fabric glove liners. The fabric can be, for example, knitted, woven or non-woven, and/or seamless or cut and sewn. The fabric can comprise for example about 70, 80 or 85% or more cut-resistant yarns (by wt). Cut resistant yarns comprise, for example, ultra high molecular weight polyethylene (UHMWPE), such as DYNEEMA®, TSUNOOGA®, a meta-aramid, such as NOMEX®, or a para-aramid, such as KEVLAR® or TWARON® (meta and para-aramids being cut-resistant polyamides). Elastic yarns, such as LYCRA®, SPANDEX®, or ELASTANE® may be used to impart flexibility. In embodiments, the fabric includes (e.g., about 70, 80 or 85% or more by wt) polycarbonate or glass fibers (including without limitation glass fiber yarn fabric). In embodiments, the fabric comprises about 70, 80 or 85% or more of a polyamide cut-resistant yarn. In embodiments, the fabric is about 98% or more, or about 100% cut-resistant yarn, such as cut-resistant polyamide yarn.

In other embodiments, the fabric is cotton, polycotton, polyester, polypropylene, or the like, or mixtures thereof.

To produce the article, typically the fabric is fitted on a former, namely a solid support shaped to support the contours of the final shape of the article. The fitting can be such that the fabric is stretched somewhat over the final sizing. Typically, the article is dipped into or has applied to it a coagulant composition, such as one containing calcium nitrate, calcium sulfate, acetic acid or another coagulant. Typically, the coagulant composition on the fabric is dried to remove solvent.

Then, the fabric on the former is dipped into, or otherwise has applied to it, an elastomer composition formulated to coagulate on contact with the coagulant. Additional coatings may be applied, with or without intervening coagulant applications. In one embodiment, the first elastomer coating includes dispersed therein the fibers discussed herein. In embodiments, the fiber-containing elastomer is the only elastomer (latex) layer applied.

In embodiments, the elastomer layer is leached, typically in aqueous fluid, prior to heat curing. After heat curing, the elastomer surface can be, in embodiments, chlorinated, followed in embodiments by contacting with a neutralization formulation.

Figure 2:
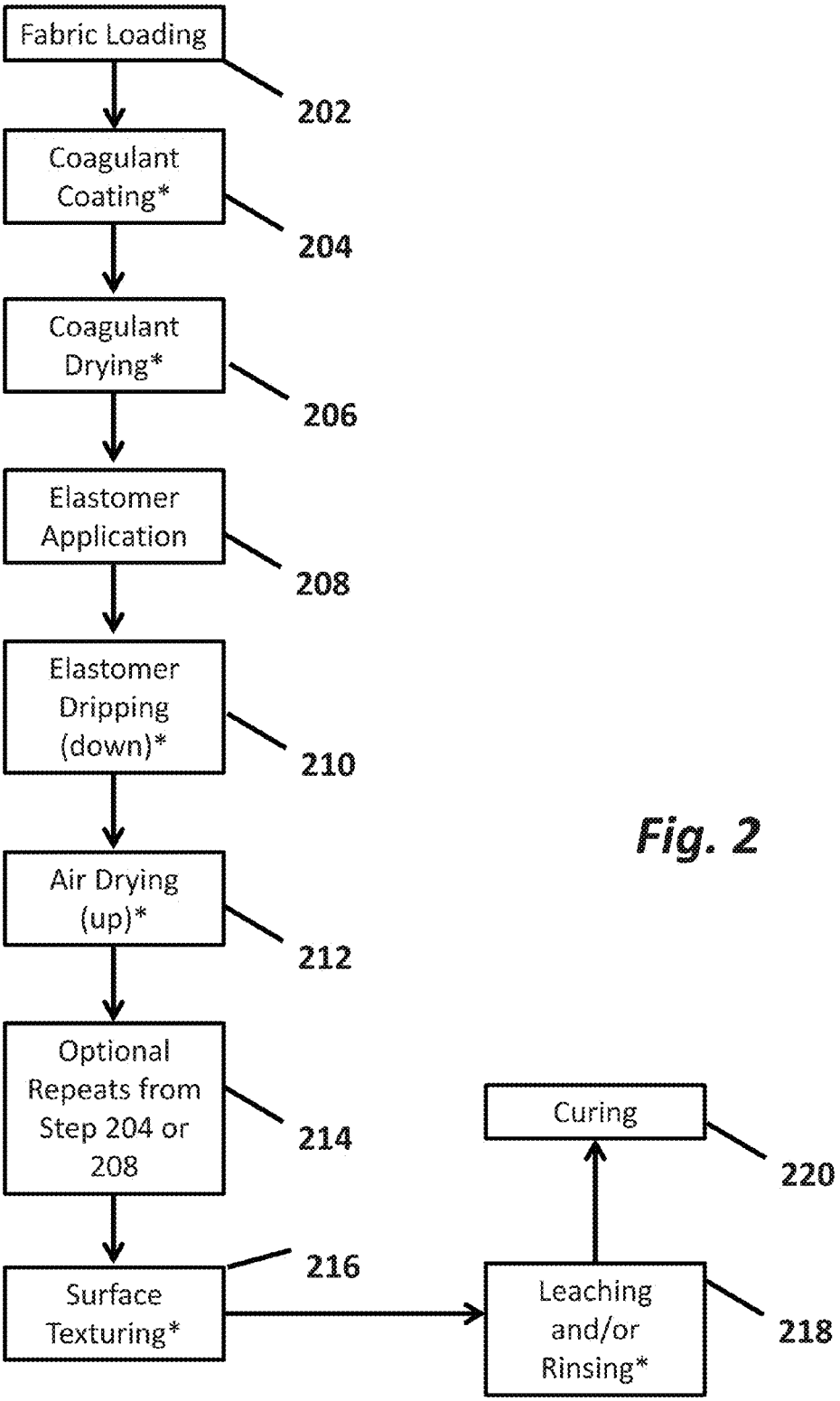
FIG. 2 is an illustrative manufacturing procedure.

An illustrative manufacturing process is shown in FIG. 2. In step 202, the fabric is loaded onto a former. In step 204, coagulant is applied to the fabric. This step, as with all steps marked with an asterisk (*) is optional. In step 206, the coagulant is dried. In step 208, elastomer is applied to the fabric. In step 210, excess elastomer is allowed to drip off. In step 212, the elastomer is air dried. In a further option, the former is re-oriented so that the article with its coating primarily faces up. Step 214 indicates that steps 204 to 212 or 208 to 212 can be repeated once or more. In step 216, texture is applied to the elastomer surface. In step 218, the article is leached or rinsed. In step 220, the article is cured, typically with heat, to crosslink the elastomer.

In embodiments, such as those using a substantially polyamide cut-resistant fabric, the mineral fibers used in the invention have a L/D ratio of between about 8 (8:1) and about 27 (27:1). In embodiments, the mineral fibers used in the invention have a L/D ratio of between about 9 and about 21. In embodiments, the mineral fibers used in the invention have a L/D ratio of between about 8 or 9 and about 16. The L/D ratio is taken based on the mass weighted average value for length, L, and on the mass weighted average value for diameter, D. (Applicant understands that Lapinus Fibres (Netherlands) measures L as the mass weighted average. If that understanding is incorrect, then L is as measured by Lapinus Fibres for fibers of the type described herein.)

In embodiments, the diameter D for the fibers (mass weighted av.) is from about 5 to about 23 micron, or from about 5 to about 12 or 15 micron. In embodiments, the length, L, for the fibers (mass weighted av.) is from about 100 to about 210 micron ($100\times10^{-6}$ m to $210\times10^{-6}$ m), or from about 100 to about 170 micron.

In embodiments, the mineral fibers used in the invention have a hardness of about 4 Mohs or higher. In embodiments, the mineral fibers have a hardness of about 5 Mohs or higher, or about 6 Mohs. The fibers can be, for example, uniformly distributed in the polymer layer.

In embodiments, the fiber content in the elastomer suspension (prior to coagulation and curing) is about 4% to about 18% w/w, such as about 8 to about 16%, or about 8.5% to about 15.5%, or about 10% to about 14%. In embodiments, the fiber content in the elastomer suspension (prior to coagulation and curing) is about 4% to about 10% w/w, such as about 5 to about 7%. In embodiments, the fiber content in the elastomer suspension (prior to coagulation and curing) is about 7% to about 13% w/w, such as about 8 to about 12%.

Illustrative fibers include, from Lapinus Fibres (Netherlands), Rockbrake RB215 (L=150, D=9, L/D=17), Rockforce MS603 (L=125, D=9, L/D=14), and Coatforce CF10 (L=125, D=7, L/D=18), and from NYCO Minerals NYAD MG (L=207, D=23, L/D=9).

In embodiments, the thickness of the polymer coating with mineral fiber is from about 0.07 to about 0.15 mm, or from about 0.5 mm to about 1.4 mm, such as about 0.7 mm to about 1.1 mm. The layer thickness can be measured by microscopic examination of a representative cross-section. The inner surface of the elastomer layer can be expected to include a number of penetrations into the fabric. These penetrations can be ignored, with the thickness being an average of a representative number of locations away from such penetrations.

In embodiments, the thickness of the fabric is from about 0.7 to about 4 mm, or about 0.91 to about 1.05 mm.

The elastomeric layers may be natural rubber latex (including Guayule latex), synthetic rubber latex, or the like, and combinations thereof. The synthetic rubber latex may be selected, for example, from the group comprised of polychloroprene, acrylonitrile butadiene copolymer (NBR or "nitrile") (such as carboxylated acrylonitrile butadiene copolymer), polyisoprene, polyurethane, styrene-butadiene, butyl, and combinations thereof.

In embodiments, the elastomeric layer with dispersed mineral fiber is about 5% or more polyurethane and about 60% or more nitrile (wt).

The article of the invention has a cut-resistance, measured with a cutting implement addressed to the polymer with dispersed mineral fiber coated side of the article, with the measurement pursuant to International ISO 13997:1999. In embodiments, the cut-resistance is 2.1600 grams or higher. In embodiments, the article has a cut-resistance of 4 or higher. An embodiment with a particularly high cut-resistance of say 9.1600 grams (20 mm) can be directly measured by the standard of International ISO 13997:1999, by adjusting loads as needed and retesting to collect five data points in the 5 to 20 mm cut-through length range. This value was compared with a control reference, without mineral fibers. In embodiments, the cut-resistance of this sample was 300 grams (20 mm). Furthermore, the distance until cut can be normalized to a load of 1000 grams, by fitting the appropriate normalization function to the results at various higher loads, the embodiment with cut-resistance of 9.1600 grams by ISO 13997:1999 is expected to have a cut-resistance of about 191.09 mm (1000 grams).

Articles according to the invention can include glove, clothing for endeavors with a high risk of cutting (such as motorcycle riding), jackets, sweaters, pants, gators, chaps, wrist covers, forearm covers, arm covers, facemasks, balaclavas, and the like. It will be recognized that in some embodiments selected high risk surfaces on the article will be coated with the polymer with dispersed mineral fiber.

All ranges recited herein include ranges therebetween, and can be inclusive or exclusive of the endpoints. Optional included ranges are from integer values therebetween (or inclusive of one original endpoint), at the order of magnitude recited or the next smaller order of magnitude. For example, if the lower range value is 0.2, optional included endpoints can be 0.3, 0.4, . . . 1.1, 1.2, and the like, as well as 1, 2, 3 and the like; if the higher range is 8, optional included endpoints can be 7, 6, and the like, as well as 7.9, 7.8, and the like. One-sided boundaries, such as 3 or more, similarly include consistent boundaries (or ranges) starting at integer values at the recited order of magnitude or one lower. For example, 3 or more includes 4 or more, or 3.1 or more.

In embodiments, the article has one or more features indicative of layer of polymer being applied by a process wherein coagulant is applied to the cut-resistant synthetic fabric to coagulate a coagulation-sensitive dispersion of polymer to form the layer of polymer. Such an indicator can include for example the presence of a detectable coagulating salt used for coagulation in an amount greater than would be expected but for the recited coagulation method. Such an indicator can include for example the lack of "break-through" in an amount that would be expected given the fabric (e.g., material, weave density, or the like) in the absence of applying coagulant to the fabric (which tends to create dams at the fabric interstices, limiting break-through). Break-through is where polymer is formed on the interior of a fabric liner.

Specific embodiments according to the methods of the present invention will now be described in the following examples. The examples are illustrative only, and are not intended to limit the remainder of the disclosure in any way.

Example 1

Gloves made with 85% polyamide yarn were coated with a blend of polyurethane/nitrile formulation, by dipping the glove into a coagulant. The coagulant is dried and the glove was then dipped into the elastomer formulation. The gloves were vulcanized for around 40 minutes, and 120° C. These gloves were used as control reference (0% fibers). The same process was studied for formulations containing different percentages of mineral fibers (as showed in FIG. 3).

Figure 3:
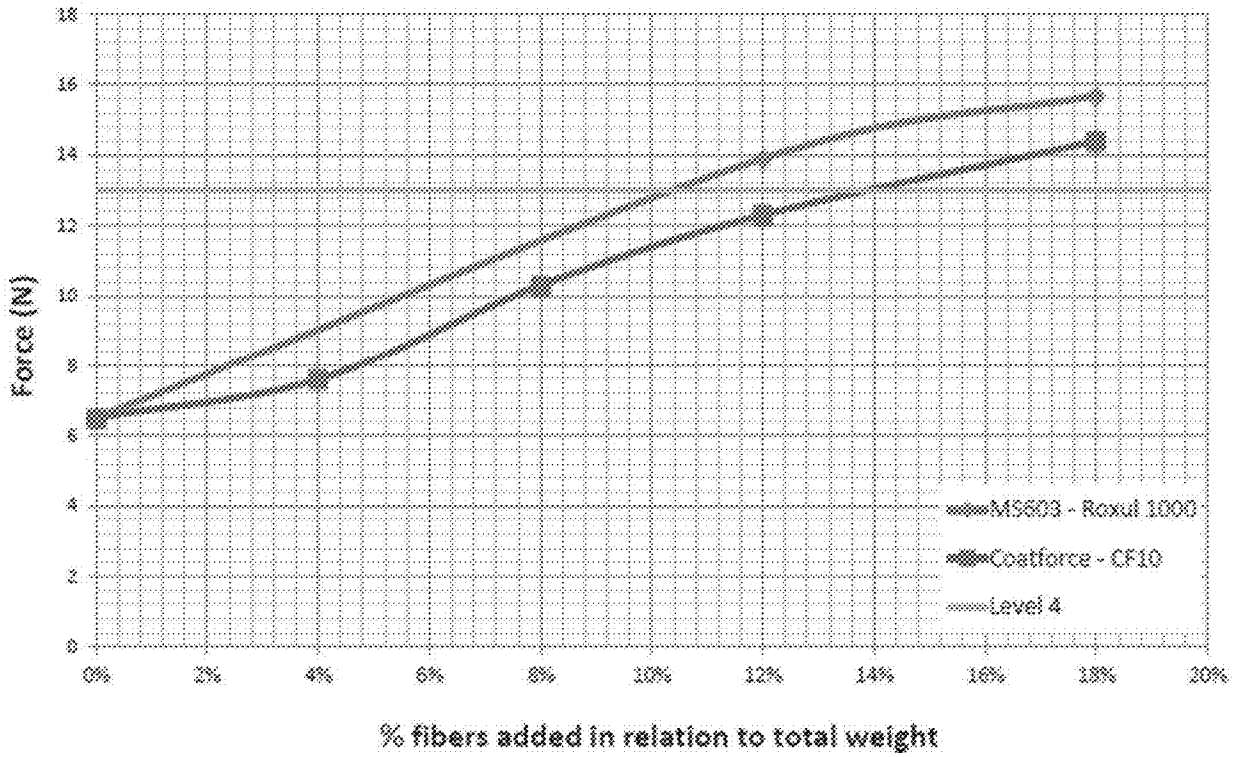
FIG. 3 shows the cut-resistance results for a number of articles according to the invention.

The results are shown in FIG. 3, in which 12% and 18% Rockforce MS603 achieved a Level 4 cut-resistance (according with ISO 13997:1999), with the 18% sample measured at 9.15.7 N (or 1600 grams/20 mm). 18% CoatForce-CF10 also achieved a Level 4 cut-resistance (14.4 N according with ISO 13997:1999). In FIG. 3, the cut-resistances achieved with Rockforce MS603 are shown with filed diamonds (♦); and those achieved with CoatForce CF10 are shown with filled squares (■). A cut level ≥4 is indicated in the Figure by a horizontal line.

Example 2

Gloves made with cotton (cut and sewn) were coated with a blend of polyurethane/nitrile formulation, by dipping the glove into a coagulant. The coagulant is dried and the glove was then dipped into the elastomer formulation. The gloves were vulcanized for around 40 minutes, and 120° C. These gloves were used as control reference (0% fibers). The same process was studied for formulations containing different percentages of mineral fibers (as showed in FIG. 4A).

Figure 4A:
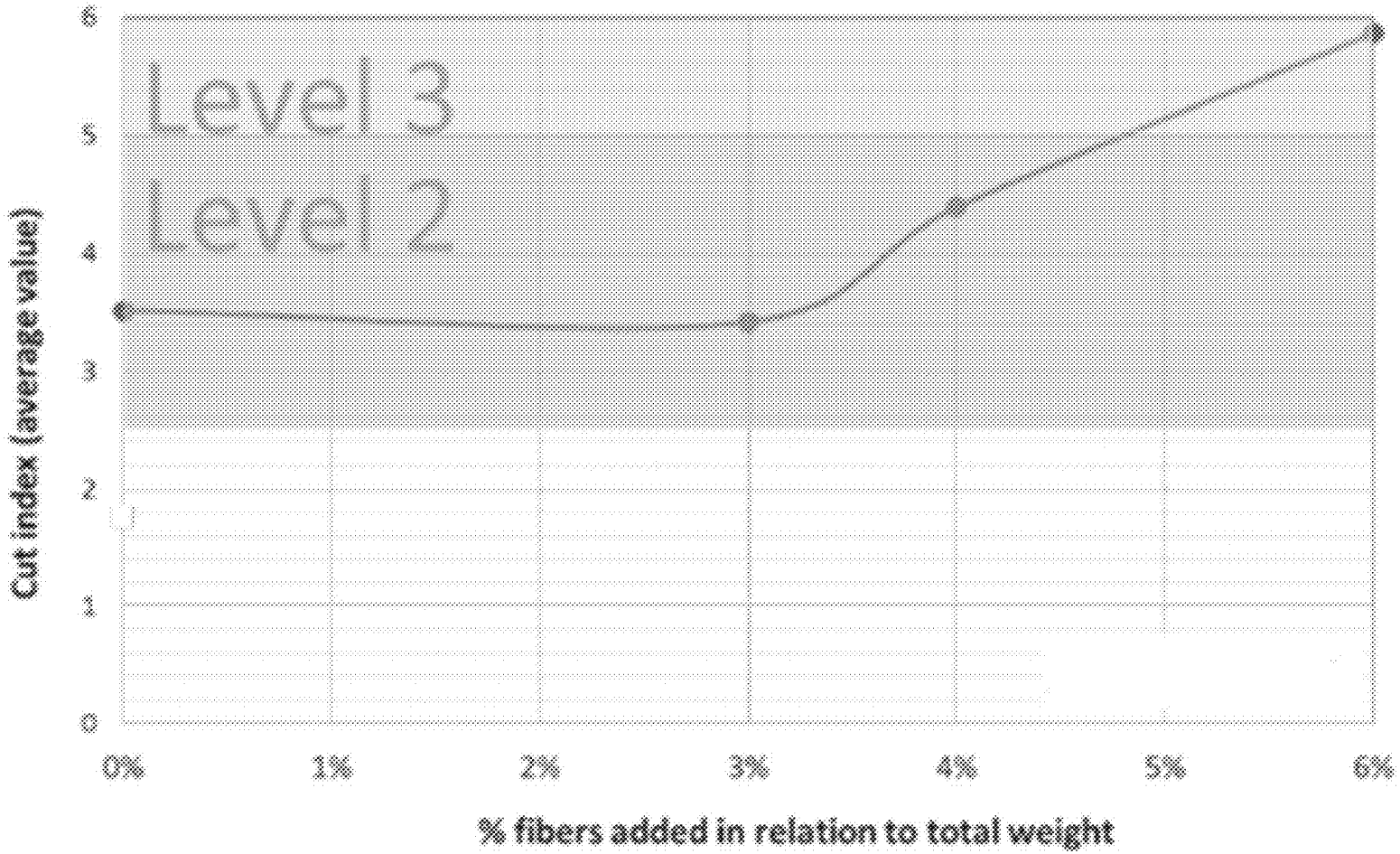
FIGS. 4A and 4B show the cut-resistance results for an article according to the invention.
Figure 4B:
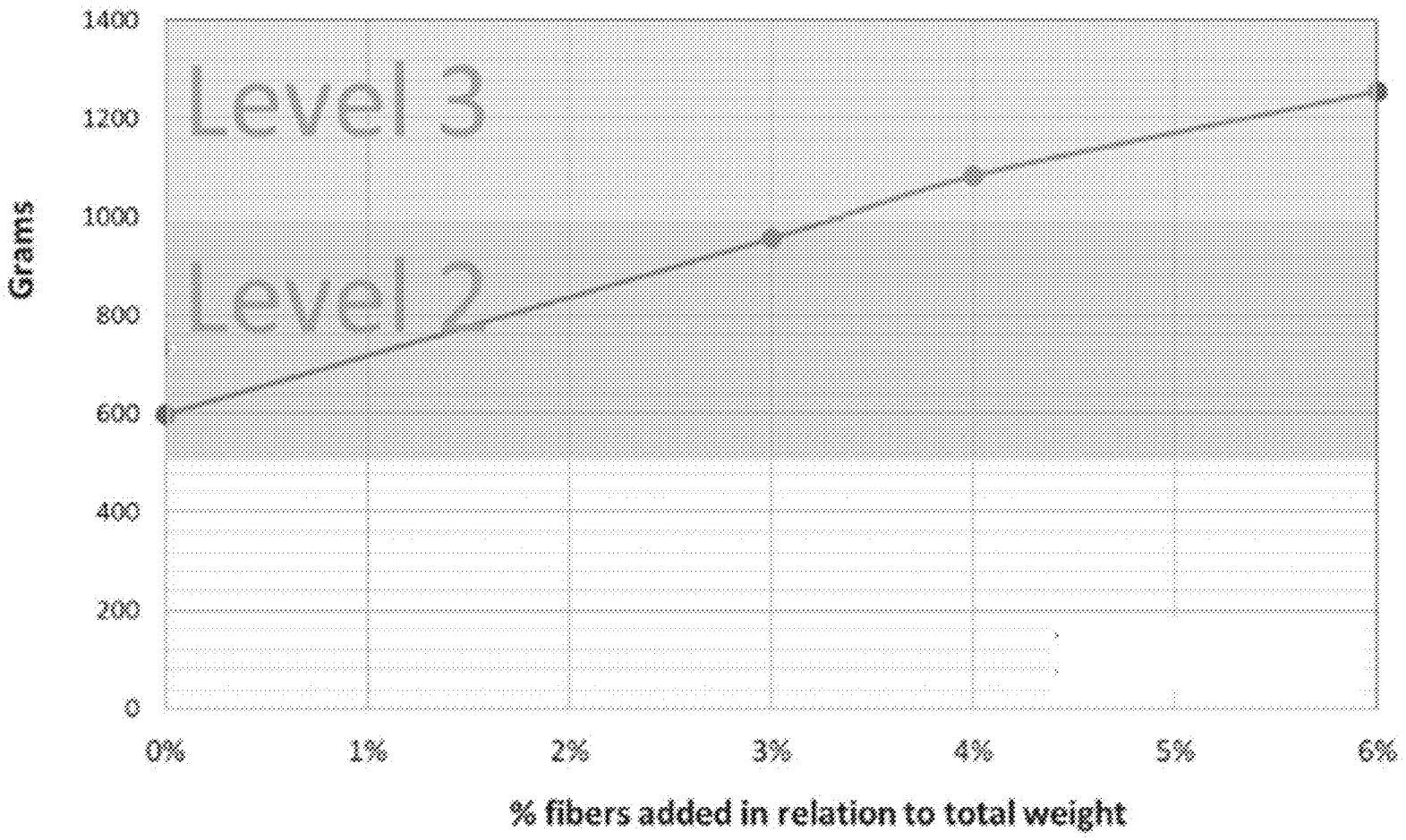

The results are shown in FIG. 4A, in which 6% Rockforce MS603 achieved a Level 3 cut-resistance (according with EN388). By ANSI/ISEA, $ % and 6% achieved Level 3 cut-resistance (<1000 grams) (FIG. 4B.)

The invention can be further described with reference to the following numbered embodiments:

Embodiment 1

A cut-resistant article comprising: a fabric; and adherent to the fabric a layer of polymer in which is dispersed mineral fibers of hardness about 4 Mohs or higher and having L/D ratio between about 8 and about 16, wherein the article has a cut resistance by ISO 13997:1999 (or EN388)(ANSI/ISEA) of 2 or higher, or 3 or higher, or 4 or higher, or 5 or higher.

Embodiment 2

The cut-resistant article of embodiment 1, wherein the particles have average D mass weighted from about 5 to about 23 micron, or another average D recited herein with respect to any embodiment.

Embodiment 3

The cut-resistant article of one of embodiments 1 or 2, wherein the particles have average L mass weighted from about 100 to about 210 micron, or another average L recited herein with respect to any embodiment.

Embodiment 4

The cut-resistant article of one of embodiments 1-3, wherein the particles have hardness of about 5 Mohs or higher, or another hardness recited herein with respect to any embodiment.

Embodiment 5

The cut-resistant article of one of embodiments 1-4, wherein the fabric is a cut-resistant synthetic fabric.

Embodiment 6

A cut-resistant article comprising: a cut-resistant synthetic fabric that is a 70% or more polyamide; and adherent to the fabric a layer of polymer comprising about 5% or more polyurethane and about 60% or more nitrile in which is dispersed mineral fibers of hardness about 4 Mohs or higher and having L/D ratio between about 8 and about 27, wherein the article has a cut resistance by ISO 13997:1999 (or EN388)(ANSI/ISEA) of 2 or higher, or 3 or higher, or 4 or higher, and wherein the polymer is adhered to the fabric by coagulation-mediated dip coating onto the fabric, and subsequent curing.

Embodiment 7

The cut-resistant article of embodiment 6, wherein the particles have average D mass weighted from about 5 to about 23 micron, or another average D recited herein with respect to any embodiment.

Embodiment 8

The cut-resistant article of one of embodiments 6 or 7, wherein the particles have average L mass weighted from about 100 to about 210 micron, or another average L recited herein with respect to any embodiment.

Embodiment 9

The cut-resistant article of one of embodiments 6-8, wherein the particles have hardness of about 5 Mohs or higher, or another hardness recited herein with respect to any embodiment.

Embodiment 10

A method of forming a cut-resistant article comprising: applying a coagulant to a fabric; coagulating on the fabric a layer of polymer in which is dispersed mineral fibers of hardness about 4 Mohs or higher and having L/D ratio between about 8 and about 27; curing the coagulated polymer; and obtaining the article, which has a cut resistance by ISO 13997:1999 (or EN388)(ANSI/ISEA) of 2 or higher, or 3 or higher, or 4 or higher.

Embodiment 11

The method of embodiment 10, wherein the particles have average D mass weighted from about 5 to about 23 micron, or another average D recited herein with respect to any embodiment.

Embodiment 12

The method of one of embodiments 10 or 11, wherein the particles have average L mass weighted from about 100 to about 210 micron, or another average L recited herein with respect to any embodiment.

Embodiment 13

The method of one of embodiments 10-12, wherein the particles have hardness of about 5 Mohs or higher, or another hardness recited herein with respect to any embodiment.

Embodiment 14

The method of one of embodiments 10-13, wherein the fabric is a cut-resistant synthetic fabric.

Embodiment 15

A cut-resistant article comprising: a fabric; and adherent to the fabric a layer of polymer in which is dispersed mineral fibers of hardness about 4 Mohs or higher and having L/D ratio between about 8 and about 27, wherein the article has a cut resistance by ISO 13997:1999 (or EN388)(ANSI/ISEA) of 2 or higher, or 3 or higher, or 4 or higher, or 5 or higher, wherein the article has one or more features indicative of layer of polymer being applied by a process wherein coagulant is applied to the cut-resistant synthetic fabric to coagulate a coagulation-sensitive dispersion of polymer to form the layer of polymer.

Embodiment 16

The cut-resistant article of embodiment 15, wherein the particles have average D mass weighted from about 5 to about 23 micron, or another average D recited herein with respect to any embodiment.

Embodiment 17

The cut-resistant article of one of embodiments 15 or 16, wherein the particles have average L mass weighted from about 100 to about 210 micron, or another average L recited herein with respect to any embodiment.

Embodiment 18

The cut-resistant article of one of embodiments 15-17, wherein the particles have hardness of about 5 Mohs or higher, or another hardness recited herein with respect to any embodiment.

Embodiment 19

The method of one of embodiments 15-18, wherein the fabric is a cut-resistant synthetic fabric.

This invention described herein is of a breach or contamination indicating elastomeric article and methods of forming the same. Although some embodiments have been discussed above, other implementations and applications are also within the scope of the following claims. Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims.

Publications and references, including but not limited to patents and patent applications, cited in this specification are herein incorporated by reference in their entirety in the entire portion cited as if each individual publication or reference were specifically and individually indicated to be incorporated by reference herein as being fully set forth. Any patent application to which this application claims priority is also incorporated by reference herein in the manner described above for publications and references.

What is claimed is:

1. A cut-resistant article comprising:

a fabric; and adherent to the fabric a layer of polymer in which is dispersed mineral fibers of hardness about 4 Mohs or higher and consisting of fibers of L/D ratio between about 8 and about 14, wherein the article has a cut resistance by EN388 of 3 or higher.

2. The cut-resistant article of claim 1, wherein the mineral fibers have average D mass weighted from about 5 to about 23 micron.

3. The cut-resistant article of claim 2, wherein the mineral fibers have average L mass weighted from about 100 to about 210 micron.

4. The cut-resistant article of claim 2, wherein the mineral fibers have average L mass weighted from about 100 to about 170 micron.

5. The cut-resistant article of claim 2, wherein the mineral fibers have hardness of about 5 Mohs or higher.

6. The cut-resistant article of claim 1, wherein the mineral fibers have hardness of about 5 Mohs or higher.

7. The cut-resistant article of claim 1, wherein the fabric is a cut-resistant synthetic fabric.

8. The cut-resistant article of claim 1, wherein the mineral fibers consist of fibers of L/D ratio of about 8 to less than 10.

9. The cut-resistant article of claim 8, wherein the fabric comprises 80% or more polyamide cut resistant yarn.

10. The cut-resistant article of claim 8, wherein the fabric comprises 85% or more polyamide cut resistant yarn.

11. The cut-resistant article of claim 8, wherein the fabric comprises 70% or more polyamide cut resistant yarn.

12. The cut-resistant article of claim 8, wherein the mineral fibers have average D mass weighted from about 5 to about 23 micron.

13. The cut-resistant article of claim 12, wherein the mineral fibers have average L mass weighted from about 100 to about 210 micron.

14. The cut-resistant article of claim 12, wherein the mineral fibers have average L mass weighted from about 100 to about 170 micron.

15. The cut-resistant article of claim 12, wherein the mineral fibers have hardness of about 5 Mohs or higher.

16. The cut-resistant article of claim 8, wherein the mineral fibers have hardness of about 5 Mohs or higher.

17. The cut-resistant article of claim 8, wherein the polymer is a substantially polyurethane polymer, and wherein the article has a cut resistance greater than that of a comparable article that substitutes the fiber with mineral fiber having L of about 125 and D of about 7.

18. The cut-resistant article of claim 8, wherein the article has a cut resistance greater than that of a comparable article that substitutes the fiber with mineral fiber having L of about 125 and D of about 7.

19. The cut-resistant article of claim 8, wherein the polymer is a substantially polyurethane polymer, and wherein the article has a cut resistance greater than that of a comparable article that substitutes the fiber with mineral fiber having L of about 125 and D of about 7.

20. The cut-resistant article of claim 1, the article has a cut resistance greater than that of a comparable article that substitutes the fiber with mineral fiber having L of about 125 and D of about 7.

* * * * *